US011730254B2

(12) United States Patent
Sun

(10) Patent No.: US 11,730,254 B2
(45) Date of Patent: Aug. 22, 2023

(54) FOLDABLE HAMMOCK

(71) Applicant: Benlong Sun, Jinhua (CN)

(72) Inventor: Benlong Sun, Jinhua (CN)

(73) Assignee: ZHEJIANG PRIDE LEISURE PRODUCTS CO., LTD., Zhejiang Province (CN)

( * ) Notice: Subject to any disclaimer, the term of this patent is extended or adjusted under 35 U.S.C. 154(b) by 237 days.

(21) Appl. No.: 17/086,508

(22) Filed: Nov. 2, 2020

(65) Prior Publication Data

US 2021/0219707 A1 Jul. 22, 2021

(30) Foreign Application Priority Data

Jan. 17, 2020 (CN) ..... 202020105083.1

(51) Int. Cl.
*A45F 3/24* (2006.01)

(52) U.S. Cl.
CPC ..... *A45F 3/24* (2013.01)

(58) Field of Classification Search
CPC ... F16M 11/38; A45F 3/24; A45F 3/22; A45F 3/26; Y10T 24/4764; Y10T 403/599; Y10T 403/60; Y10T 403/602; A47D 13/107; A47C 17/72
See application file for complete search history.

(56) References Cited

U.S. PATENT DOCUMENTS 3,859,693 A * 1/1975 Breed ..... B63B 21/04 294/82.23
7,441,287 B2 * 10/2008 Zheng ..... A45F 3/24 5/120
7,752,721 B2 * 7/2010 Lin ..... F16B 45/04 24/600.6
2006/0282948 A1 * 12/2006 Deng ..... A45F 3/24 5/127

FOREIGN PATENT DOCUMENTS

AT 143892 B * 2/1934

OTHER PUBLICATIONS

English Translation of AT 143892 B (Year: 1934).*

* cited by examiner

*Primary Examiner* — David R Hare
*Assistant Examiner* — Amanda L Bailey
(74) *Attorney, Agent, or Firm* — WPAT Law, P.C.; Anthony King

(57) ABSTRACT

A foldable hammock having a main frame assembly and a fabric assembly. The fabric assembly has two hanging rings 3, two fabric support tubes and a fabric. The main frame assembly has two fabric-pulling base assemblies, two cross assemblies, two side frame assemblies and two portable belts. A foldable frame is adopted, so that the hammock is convenient to store and carry; the fabric and the frame are detachable, so that assembly and disassembly are convenient (Continued)

and fast; and the foldable hammock can be used outdoors without trees or other support objects.

8 Claims, 11 Drawing Sheets

FOLDABLE HAMMOCK

BACKGROUND OF THE INVENTION

1. Technical Field

The utility model belongs to the technical field of outdoor products, and particularly relates to a foldable hammock.

2. Description of Related Art

As portable beds easy to carry in outdoor activities, hammocks typically consist of thin canvas and ropes at the two ends of the thin canvas, and the ropes at the two ends of the hammocks are generally tied on trees to be fixed. The hammocks of such structure are convenient to carry. However, due to the fact that the two ends of the hammocks have to be tied on stationary objects or firm trunks, so that usage of the hammocks is limited by the environment, and the hammocks cannot be used in places where objects for binding the hammocks are not available.

In view of the above defects, the structure of the hammocks is improved to reduce the requirements for environmental factors.

BRIEF SUMMARY OF THE INVENTION

The objective of the utility model is to overcome the defect that traditional hammocks have to be normally used in specific environments by providing a hammock which can be rapidly folded to be stored, is convenient to carry, and does not need to be tied or fixed on two specific trees.

To fulfill the above object, the technical solution adopted by the utility model is as follows: a foldable hammock comprises a main frame assembly and a fabric assembly, wherein the main frame assembly comprises two cross assemblies and two side frame assemblies; each cross assembly comprises four cross connecting bases and two cross tubes which are hinged together in an X shape and have four ends respectively hinged to the four cross connecting bases;

Each side frame assembly comprises two back tubes, two back tube connecting bases, two support tubes, two bottom tube connecting bases, two bottom tubes, two bottom tube sleeves, and two back tube limiting bases, wherein one back tube limiting base and one back tube limiting base are respectively fixed to the middle and the bottom of one back tube; the two bottom tubes are hinged together in a cross manner, and one bottom tube sleeve and one bottom tube connecting base are respectively fixed two ends of each bottom tube; the bottom tube sleeve on one bottom tube is hinged to the back tube limiting base on the other bottom tube, and two ends of each support tube are respectively hinged to one back tube connecting base and one bottom tube connecting base, and the upper ends of the two back tubes are respectively connected to the two ends of the fabric assembly.

The two cross connecting bases at the upper end of each cross assembly are respectively hinged to the two back tubes on one side of the two side frame assemblies, and the two cross connecting bases at the lower end of each cross assembly are respectively hinged to the two bottom tube connecting bases on one side of the two side frame assemblies.

Furthermore, the main frame assembly further comprises two fabric-pulling base assemblies, the upper ends of the two back tubes on one side of the two side frame assemblies are connected through one fabric-pulling base assembly, and the two ends of the fabric assembly are respectively connected to the two fabric-pulling base assemblies.

Furthermore, each fabric-pulling base assembly consists of a rivet, a button, a spring, a button holder and a hanging ring holder, wherein the button and the spring are arranged in a groove in the button holder, the button presses the spring to make the rivet sequentially penetrate through the button holder, a long strip-shaped hole in the button, and the hanging ring holder to connect the button holder, the button and the hanging ring holder together, the button is able to move upwards or downwards through the long strip-shaped hole under the effect of the spring, and the button holder and the hanging ring holder are able to axially rotate around the rivet; and the upper ends of the two back tubes of each side frame assembly are respectively inserted into the button holder of one fabric-pulling base assembly and the hanging ring holder of the other fabric-pulling base assembly, and the two side frame assemblies and the two fabric-pulling base assemblies are connected end to end to form a frame.

Furthermore, the fabric assembly comprises two hanging rings and a fabric, the two hanging rings are respectively fixed to the left side and the right side of the fabric, and after the buttons are pressed, the hanging rings are clamped in grooves of the hanging ring holders.

Furthermore, the fabric assembly further comprises two fabric support tubes which are respectively arranged in the left side and the right side of the fabric to stretch and shape the fabric.

Furthermore, the main frame assembly further comprises two portable belts, the two ends of one portable belt are respectively fixed to the upper ends of the two bottom tubes on the left side, and the two ends of the other portable belt are respectively fixed to the upper ends of the two bottom tubes on the right side.

Compared with the prior art, the utility model has the following beneficial effects: a foldable frame is adopted, so that the hammock is convenient to store and carry; the fabric and the frame are detachable, so that assembly and disassembly are convenient and fast; and the foldable hammock can be used outdoors without trees or other support objects.

In the figures: 1, main frame assembly; 2, fabric assembly; 3, hanging ring; 4, fabric support tube; 5, fabric; 6, fabric-pulling base assembly; 7, cross assembly; 8, side frame assembly; 9, portable belt; 10, back tube; 11, back tube connecting base; 12, support tube; 13, bottom tube connecting base; 14, bottom tube; 15, bottom tube sleeve; 16, back tube limiting base; 17, cross connecting base; 18, cross tube; 19, rivet; 20, button; 21, spring; 22, button holder; 23, hanging ring holder.

DETAILED DESCRIPTION OF THE INVENTION

To make the technical solution of the utility model clearer and easier to understand, the technical solution of the utility model is further described and explained below with reference to specific embodiments. Those skilled in the art can easily appreciate other advantages and effects of the utility model by referring to the contents in the specification. The utility model can also be implemented or applied through other specific embodiments, and on the basis of different viewpoints and applications, all details in the specification can be modified or transformed in various ways without deviating from the spirit of the utility model.

Figure 1:
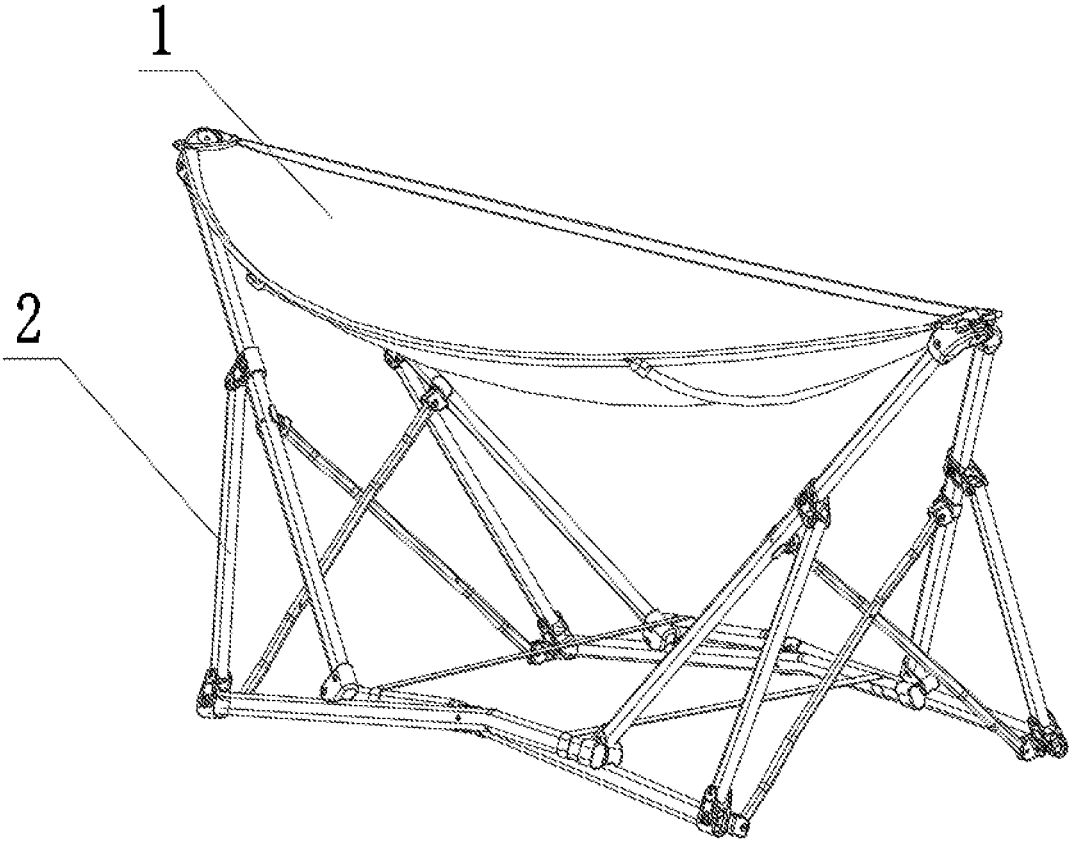
FIG. 1 is a structural schematic diagram of a foldable hammock.
Figure 2:
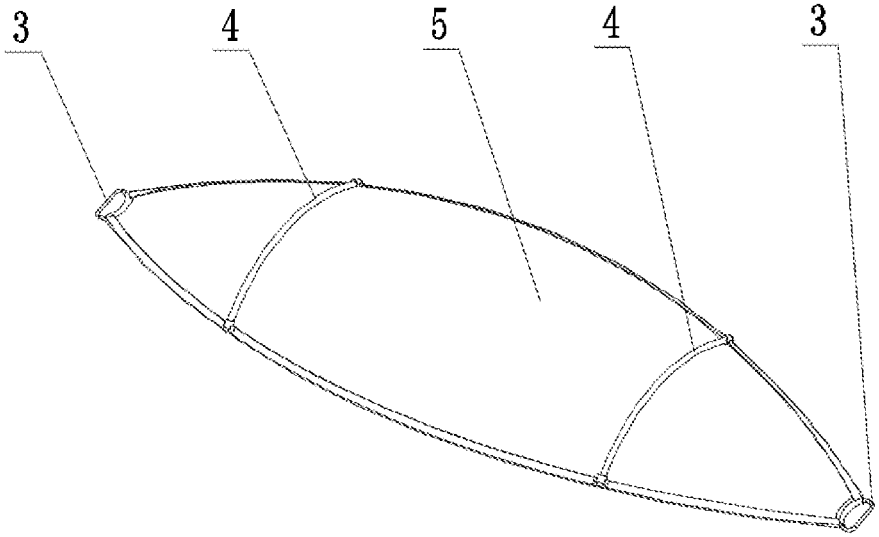
FIG. 2 is a structural schematic diagram of a fabric assembly.
Figure 3:
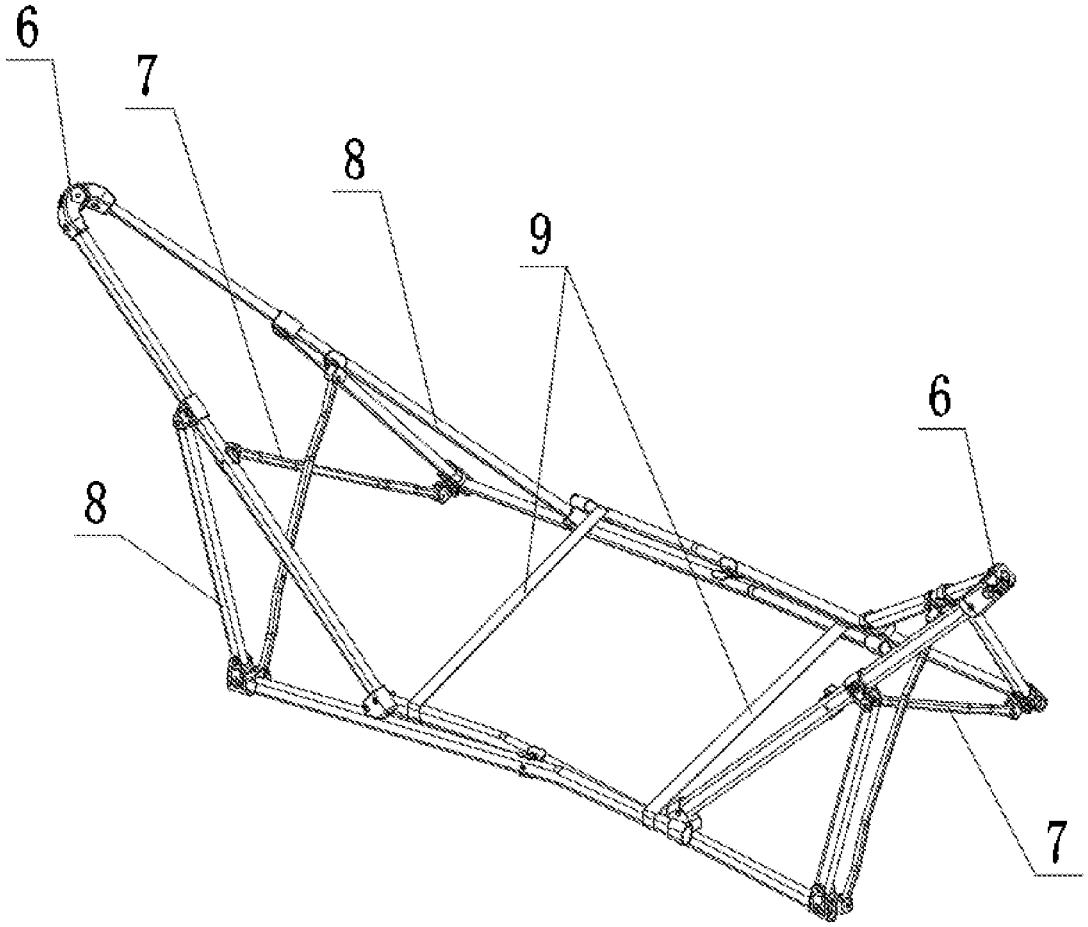
FIG. 3 is a schematic diagram of a main frame assembly in an unfolded state.

As shown in the figures, this embodiment discloses a foldable hammock which consists of a main frame assembly 1 and a fabric assembly 2, as shown in FIG. 1. The fabric assembly 2 consists of two hanging rings 3, two fabric support tubes 4 and a fabric 5 (as shown in FIG. 2). The main frame assembly 1 consists of two fabric-pulling base assemblies 6, two cross assemblies 7, two side frame assemblies 8, and two portable belts 9 (as shown in FIG. 3).

Figure 7:
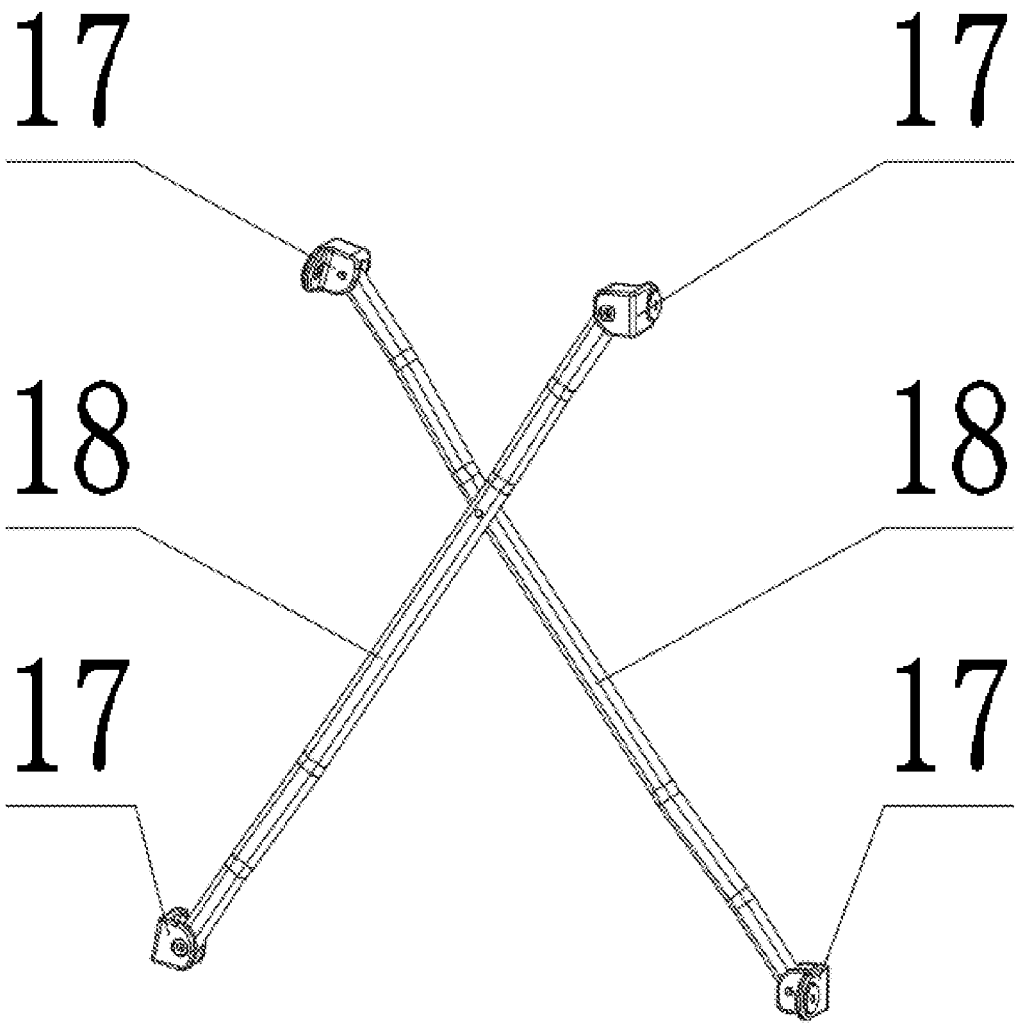
FIG. 7 is a schematic diagram of a cross assembly in an unfolded state.
Figure 8:
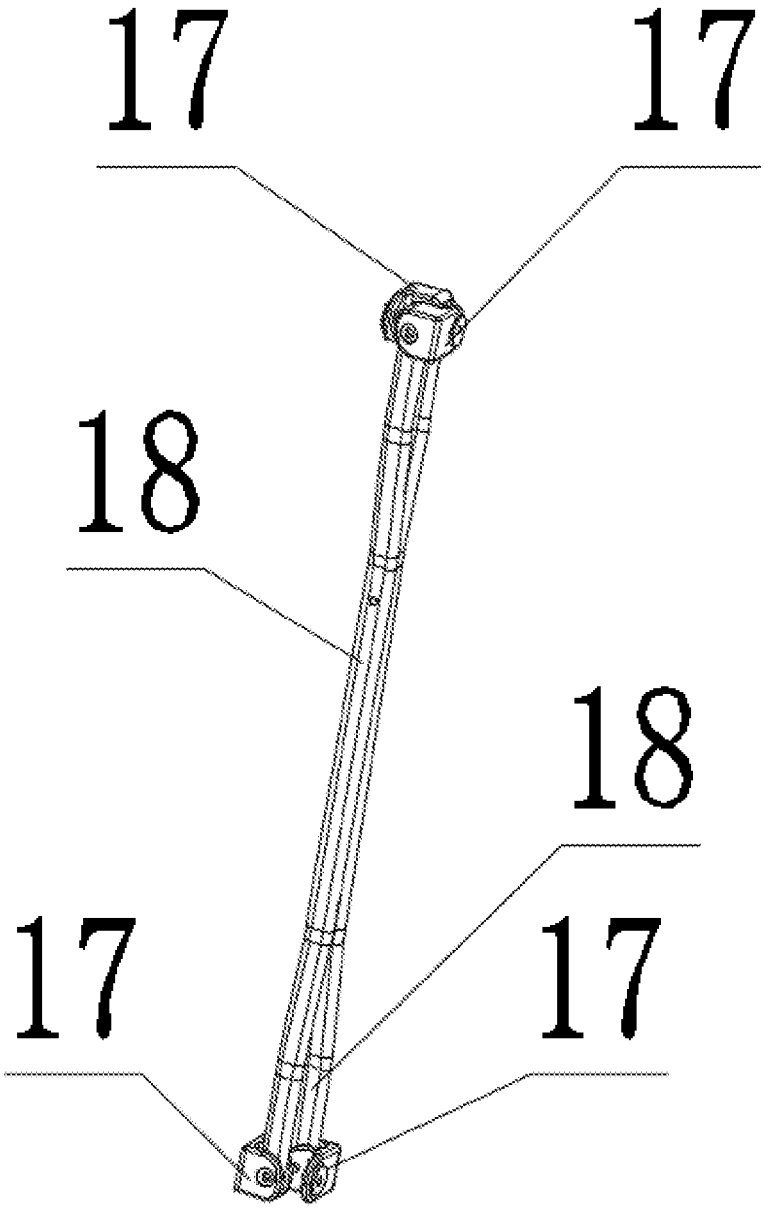
FIG. 8 is a schematic diagram of the cross assembly in a folded state.

As shown in FIG. 7, each cross assembly 7 comprises four cross connecting bases 17 and two cross tubes 18, wherein the two cross tubes 18 are hinged together in an X shape, and the four cross connecting bases 17 are respectively hinged to the two ends of the two cross tubes 18.

Figure 5:
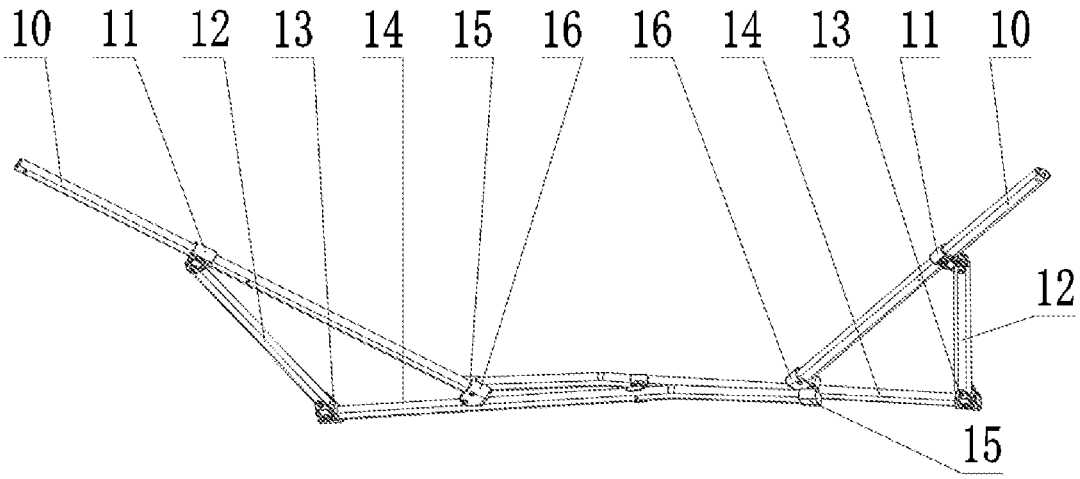
FIG. 5 is a schematic diagram of a side frame assembly in an unfolded state.

As shown in FIG. 5, each side frame assembly 8 comprises two back tubes 10, two back tube connecting bases 11, two support tubes 12, two bottom tube connecting bases 13, two bottom tubes 14, two bottom tube sleeves 15, and two back tube limiting bases 16, wherein one back tube connecting base 11 and one back tube limiting base 16 are respectively fixed to the middle and the bottom of one back tube 10; the two bottom tubes 14 are connected in a cross manner, one bottom tube sleeve 15 and one bottom tube connecting base 13 are respectively fixed to the two ends of each bottom tube 14, the bottom tube sleeve 15 on one bottom tube is hinged to the back tube limiting base 16 on the other bottom tube, and the two ends of each support tube 12 are respectively hinged to one back tube connecting base 11 and one bottom tube connecting base 13; and the upper ends of the two back tubes 10 are respectively connected to the two ends of the fabric assembly 2; and the two cross connecting bases 17 at the upper end of each cross assembly 7 are respectively hinged to the two back tubes 10 on the same side of the two side frame assemblies 8, and the two cross connecting bases 17 at the lower end of the cross assembly 7 are respectively hinged to the two bottom connecting bases 13 on the same side of the two side frame assemblies 8.

The upper ends of the two back tubes 10 on the same side of the two side frame assemblies 8 are connected through one of the two fabric-pulling base assemblies 6, and the two ends of the fabric assembly 2 are respectively connected to the two fabric-pulling base assemblies 6.

Figure 9:
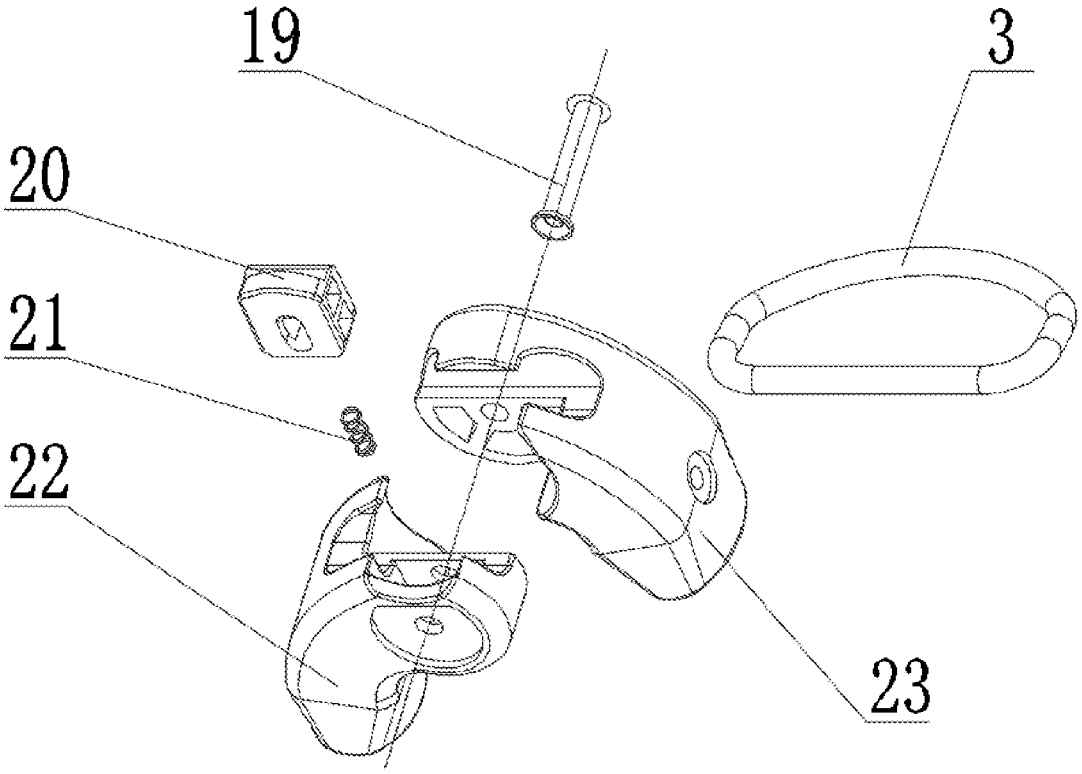
FIG. 9 is a disassembled view of a fabric-pulling base assembly.

In a preferred embodiment, each fabric-pulling base assembly 6 comprises a rivet 19, a button 20, a spring 21, a button holder 22 and a hanging ring holder 23, as shown in FIG. 9, wherein the button 20 and the spring 21 are arranged in a groove in the button holder 22, the button 20 is able to compress the spring 21 to make the rivet 19 sequentially penetrate through the button holder 22, a long strip-shaped hole in the button 20, and the hanging ring holder 23 to connect the button holder 22, the button 20 and the hanging ring holder 23 together, the button 20 can move upwards or downwards via the long strip-shaped hole under the effect of the spring 21, and the button holder 22 and the hanging ring holder 23 can axially rotate around the rivet 19.

According to the main frame assembly 1 in this embodiment, one of the two back tubes 10 of one side frame assembly 8 is inserted into the hanging ring holder 23 of one fabric-pulling base assembly 6, and the other back tube 10 is inserted into the button holder 22 of the other fabric-pulling base assembly 6; one back tube 10 of the other side frame assembly 8 is inserted into the button holder 22 of the corresponding fabric-pulling base assembly 6, and the other back tube 10 is inserted into the hanging ring holder 23 of the other fabric-pulling base assembly 6, so that an end-to-end frame is formed. The two cross connecting bases 17 at the upper end of one cross tube assembly 7 are respectively hinged to the two back tubes 10 on the left side of the main frame assembly, and the two cross connecting bases 17 at the lower end of the cross tube assembly 7 are respectively hinged to the two bottom tube connecting bases 13 on one side of the main frame assembly. The two cross connecting bases 17 at the upper end of the other cross tube assembly 7 are respectively hinged to the two back tubes 10 on the right side of the main frame assembly, and the two cross connecting bases 17 at the lower end of the cross tube assembly 7 are respectively hinged to the two bottom tube connecting bases 13 on the other side of the main frame assembly. One portable belt 9 is fixed to the upper ends of the two bottom tubes 14 on one side of the frame, and the other portable belt 9 is fixed to the upper ends of the two bottom tubes 14 on the other side of the frame (as shown in FIG. 3).

Figure 12:
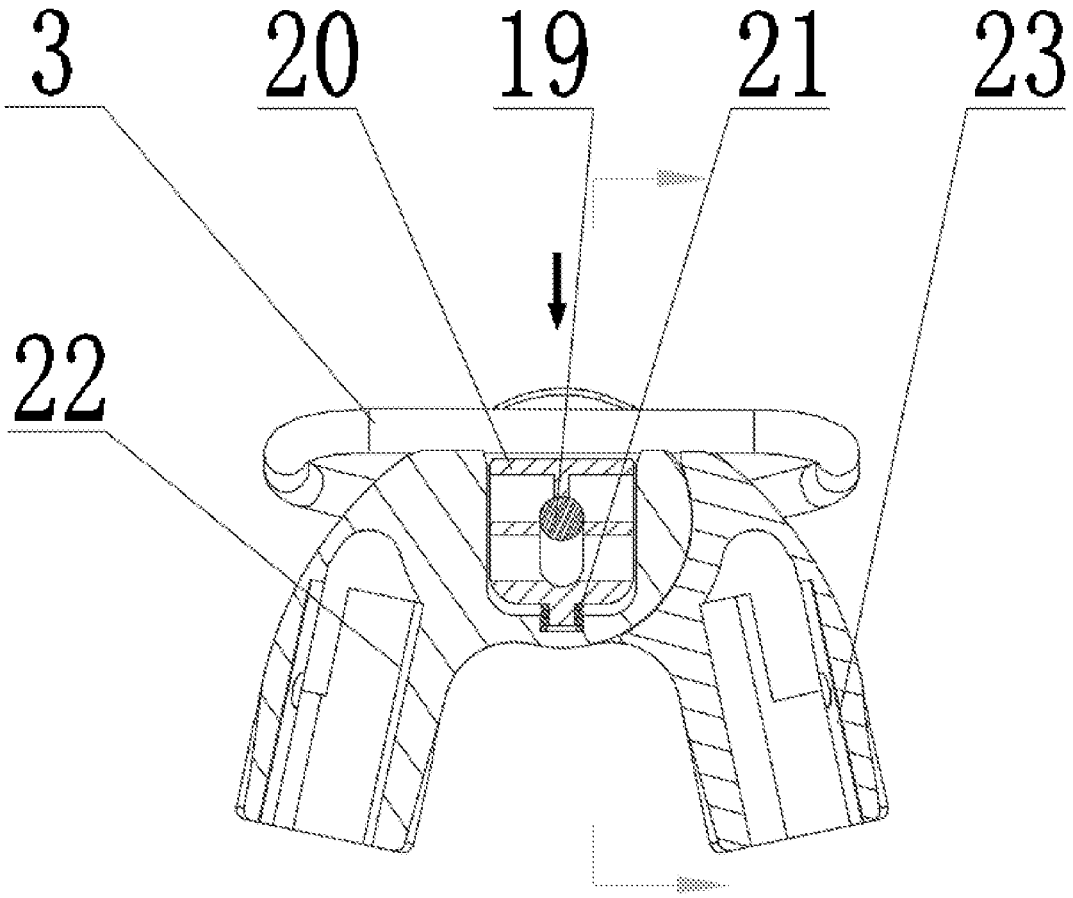
FIG. 12 is an assembly and disassembly view of the hanging ring.
Figure 13:
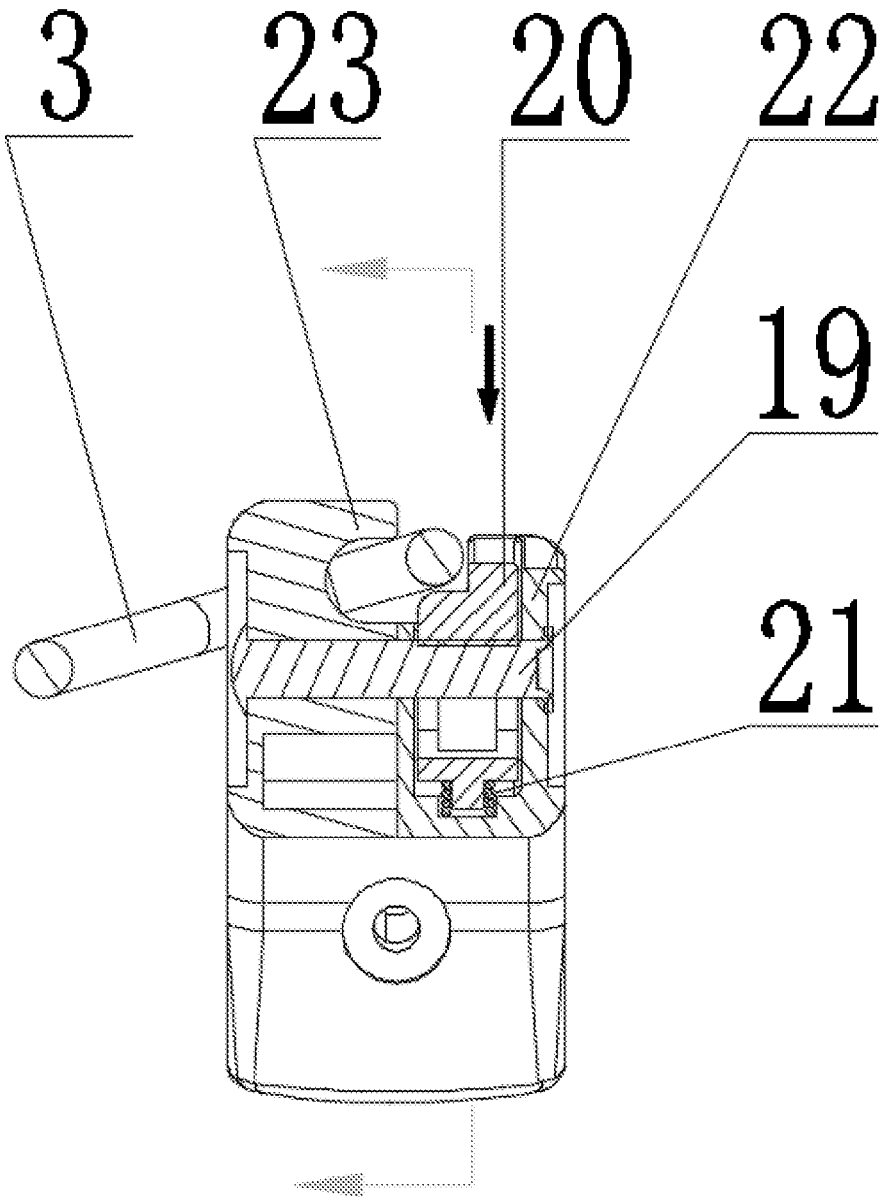
FIG. 13 is a side view of FIG. 12.

The fabric assembly 2 comprises two hanging rings 3 and a fabric 5, wherein the two hanging rings 3 are respectively fixed to the left side and the right side of the fabric 5, and after the buttons 20 are pressed, the hanging rings 3 are clamped in grooves of the hanging ring holders 23. The buttons 20 on the fabric-pulling base assemblies 6 are pressed to assemble the hanging rings 3 in the fabric assembly 2 (as shown in FIG. 12 and FIG. 13).

In a preferred embodiment, the fabric assembly 2 further comprises two fabric support tubes 4 which are respectively arranged in the left side and the right side of the fabric 5 to unfold and shape the fabric 5.

In this embodiment, the main frame assembly 1 further comprises two portable belts 9, wherein the two ends of one portable belt 9 are respectively fixed to the upper ends of the two bottom tubes 14 on the left side, and the two ends of the other portable belt 9 are respectively fixed to the upper ends of the two bottom tubes 14 on the right side.

In a preferred embodiment, the hanging rings 3 are preferably iron hooks and are optimally oval in shape.

Figure 4:
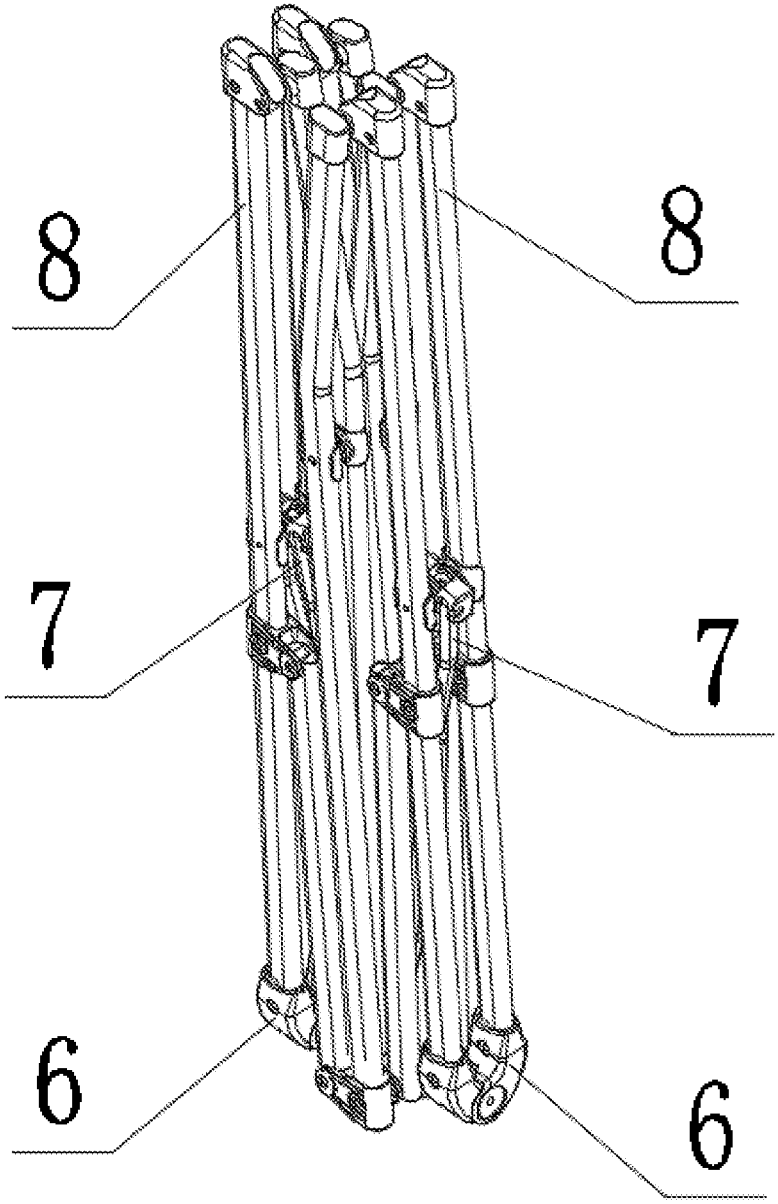
FIG. 4 is a schematic diagram of the main frame assembly in a folded state.
Figure 6:
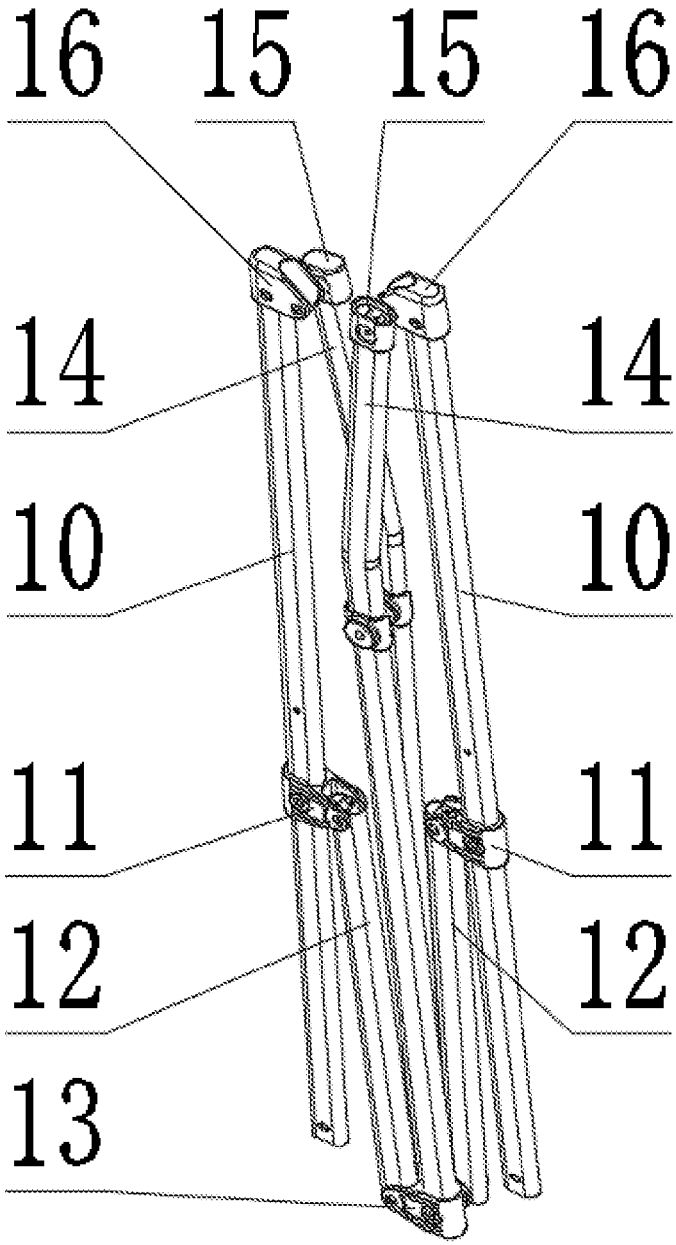
FIG. 6 is a schematic diagram of the side frame assembly in a folded state.

The folding process of the hammock is as follows:

The button 20 on one side is pressed to take the iron hanging ring 3 out of the groove of the hanging ring holder 23 on this side (as shown in FIG. 12 and FIG. 13); the button 20 on the other side is pressed to take the iron hanging ring 3 out of the groove of the hanging ring holder 23 on this side; and then, the fabric assembly 2 is disassembled. Afterwards, the two portable belts 9 are lifted upwards with both hands to drive one end of the four bottom tubes 14 fixed to the two ends of the portable belts 9 to rotate upwards around the hinge axes to be folded. Meanwhile, the ends of the back tubes arranged around the back tube limiting bases 16 connected to these ends are driven to move upwards. The middle portions of the back tubes 10 are connected to the support tubes 12 through the back tube connecting bases 11 to form lever structures, so that the fabric-pulling base assemblies 6 at the other ends of the back tubes are driven to move downwards. When one end of the four bottom tubes 14 are rotated upwards to be folded, the other ends of the four bottom tubes 14 drive the support tubes 12 to pull the back tubes 10 to downwards rotate synchronously to be folded through the bottom tube connecting bases 13 (as shown in FIG. 6). At this moment, the two cross tubes in each cross assembly 7 gradually coincide when the back tubes turn upwards and downwards to pull the two side frame assemblies 8 to draw close to the middle until the fabric-pulling base assemblies 6 touch the support tubes 12 (as shown in FIG. 4), so that the hammock is folded.

Figure 10:
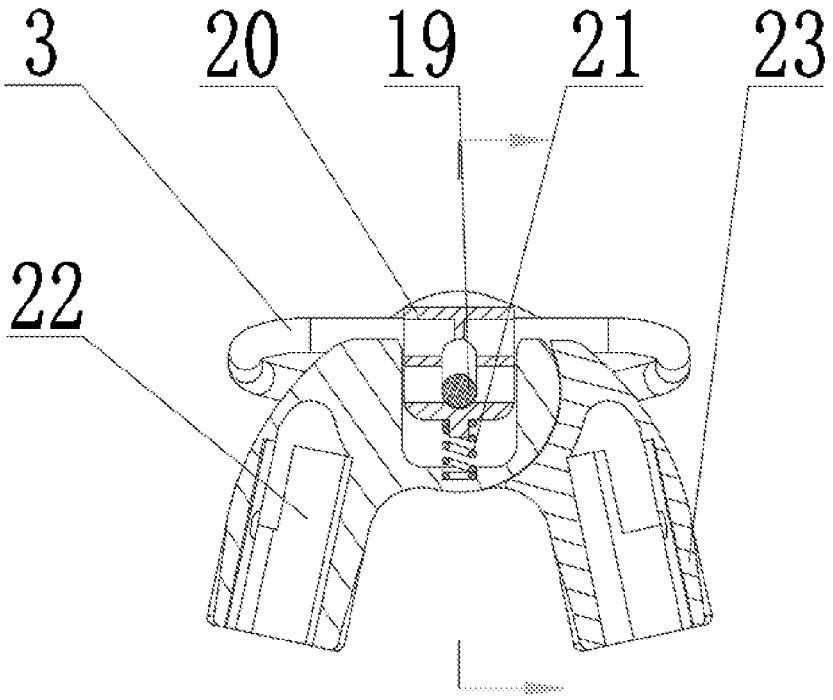
FIG. 10 is a schematic diagram of a hanging ring in a locked state.
Figure 11:
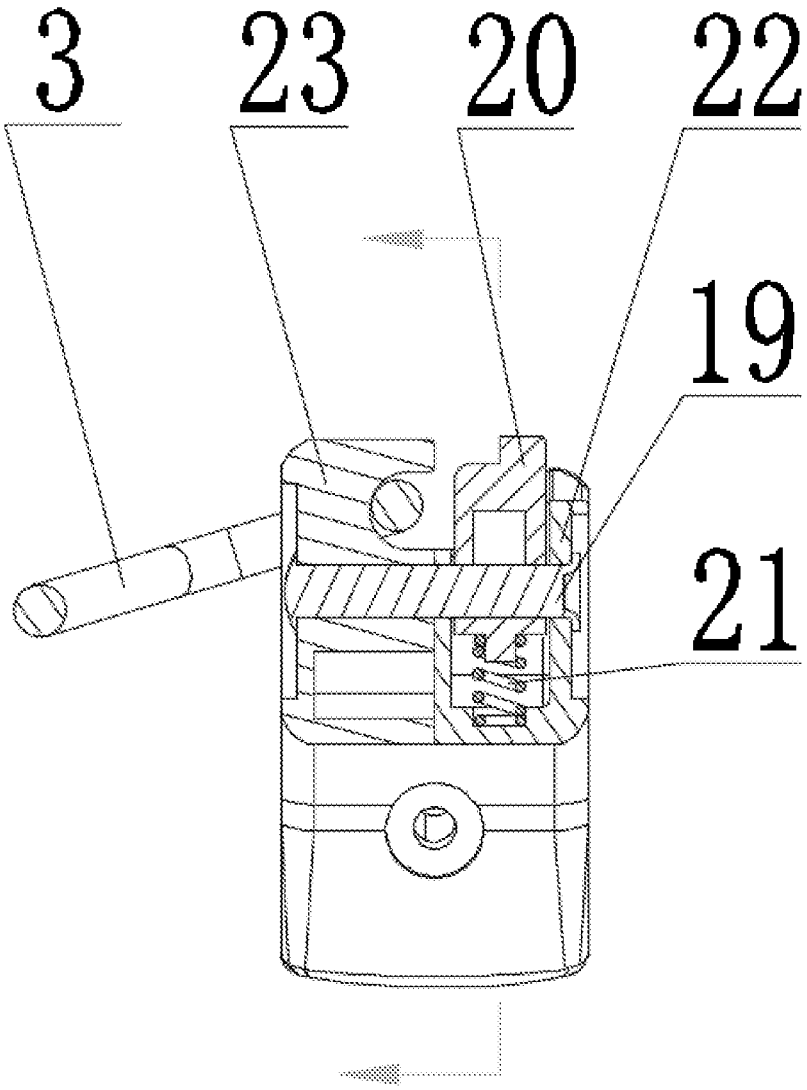
FIG. 11 is a side view of FIG. 10.

The unfolding process of the frame assembly in this embodiment is as follows:

The two fabric-pulling base assemblies 6 are unfolded towards the two sides with both hands to drive the four back tubes 10 to rotate around the hinge axes of the bottom tube sleeves 15 and the back tube limiting bases 16, so that the back tube connecting bases 11 in the middle of the back tubes to drive the ends of the bottom tube connecting bases 13 of the bottom tubes 14 to stretch outwards through the support tubes 12. Because the two bottom tubes 14 are connected in the cross manner, the bottom tube sleeve 15 and the back tube limiting base 16 at the other end are driven to rotate to be unfolded when the ends of the bottom tube connecting bases 13 stretch outwards. When the four back tubes 10 are turned to be unfolded, the four cross tubes 18 drive the two side frame assemblies 8 to stretch towards the two sides until the back tube limiting bases 16 abut against the bottom tubes 14 (as shown in FIG. 3 and FIG. 5). The button 20 on one side is pressed to clamp the iron hanging ring 3 into the groove of the hanging ring holder 23 in this side (as shown in FIG. 10 and FIG. 11); and then, the button 20 on the other side is pressed to clamp the iron hanging ring 3 on this side into the groove of the corresponding hanging ring holder 23, so that the fabric assembly 2 is assembled, and the hammock is unfolded (as shown in FIG. 1).

The above embodiments are preferred ones of the utility model, and are not intended to limit the protection scope of the utility model. All transformations and improvements achieved by those skilled in the art according to the design concept of the utility mode should also fall within the protection scope of the utility model. More particularly, various transformations and improvements can be made on the components and/layout of the subject matter within the scope defined by the disclosure, drawings and claims of this application. In addition to the transformations and improvements of the components and/or layout, other purposes of the utility model will also be obvious to those skilled in the art.

What is claimed is:

1. A foldable hammock, comprising a main frame assembly (1) and a fabric assembly (2), wherein the main frame assembly (1) comprises two cross assemblies (7) and two side frame assemblies (8); each said cross assembly (7) comprises four cross connecting bases (17) and two cross tubes (18) which are hinged together in an X shape and have four ends respectively hinged to the four cross connecting bases (17);

each said side frame assembly (8) comprises two back tubes (10), two back tube connecting bases (11), two support tubes (12), two bottom tube connecting bases (13), two bottom tubes (14), two bottom tube sleeves (15) and two back tube limiting bases (16), wherein one of said two back tube connecting bases (11) and one of said two back tube limiting bases (16) are respectively fixed to a middle and a bottom of one said back tube (10); the two bottom tubes (14) are hinged together in a cross manner, one said bottom tube sleeve (15) and one said bottom tube connecting base (13) are respectively fixed to ends of each said bottom tube (14), the bottom tube sleeve (15) on one said bottom tube is hinged to the back tube limiting base (16) on the other bottom tube, and two ends of each said support tube (12) are respectively hinged to one said back tube connecting base (11) and one said bottom tube connecting base (13); and upper ends of the two back tubes (10) are respectively connected to two ends of the fabric assembly (2);

the two cross connecting bases (17) at an upper end of each said cross assembly (7) are respectively hinged to the two back tubes (10) on the one side of the two side frame assemblies (8), and the two cross connecting bases (17) at a lower end of each said cross assembly (7) are respectively hinged to the two bottom tube connecting bases (13) on one side of the two side frame assemblies (8);

wherein the main frame assembly (1) further comprises two fabric-pulling base assemblies (6), upper ends of the two back tubes (10) on one of the sides of the two side frame assemblies (8) are connected through one of said two fabric-pulling base assemblies (6), and said two ends of the fabric assembly (2) are respectively connected to the two fabric-pulling base assemblies (6);

wherein each said fabric-pulling base assembly (6) consists of a rivet (19), a button (20), a spring (21), a button holder (22) and a hanging ring holder (23), wherein the button (20) and the spring (21) are arranged in a groove in the button holder (22), the button (20) presses the spring (21) to make the rivet (19) sequentially penetrate through the button holder (22), a long strip-shaped hole in the button (20), and the hanging ring holder (23) to connect the button holder (22), the button (20) and the hanging ring holder (23) together, the button (20) is able to move upwards or downwards through the long strip-shaped hole under the effect of the spring (21), and the button holder (22) and the hanging ring holder (23) are able to axially rotate around the rivet (19);

the upper ends of the two back tubes (10) of each said side frame assembly (8) are respectively inserted into the button holder (22) of one said fabric-pulling base assembly (6) and the hanging ring holder (23) of the other fabric-pulling base assembly (6), and the two side frame assemblies (8) and the two fabric-pulling base assemblies (6) are connected end to end to form a frame.

2. The foldable hammock according to claim 1, wherein the fabric assembly (2) comprises two hanging rings (3) and a fabric (5), the two hanging rings (3) are respectively fixed to a left side and a right side of the fabric (5), the hanging rings (3) are configured to be clamped in grooves of the hanging ring holders (23) after the buttons are pressed.

3. The foldable hammock according to claim 2, wherein the fabric assembly (2) further comprises two fabric support tubes (4) which are respectively arranged in the left side and the right side of the fabric (5) to stretch and shape the fabric (5).

4. The foldable hammock according to claim 1, wherein the main frame assembly (1) further comprises two portable belts (9), two ends of one said portable belt (9) are respectively fixed to upper ends of the two bottom tubes (14) on a left side, and two ends of the other portable belt (9) are respectively fixed to upper ends of the two bottom tubes (14) on a right side.

5. The foldable hammock according to claim 1, wherein the main frame assembly (1) further comprises two portable belts (9), two ends of one said portable belt (9) are respectively fixed to upper ends of the two bottom tubes (14) on a left side, and two ends of the other portable belt (9) are respectively fixed to upper ends of the two bottom tubes (14) on a right side.

6. The foldable hammock according to claim 1, wherein the main frame assembly (1) further comprises two portable belts (9), two ends of one said portable belt (9) are respectively fixed to upper ends of the two bottom tubes (14) on a left side, and two ends of the other portable belt (9) are respectively fixed to upper ends of the two bottom tubes (14) on a right side.

7. The foldable hammock according to claim 2, wherein the main frame assembly (1) further comprises two portable belts (9), two ends of one said portable belt (9) are respectively fixed to upper ends of the two bottom tubes (14) on a left side, and two ends of the other portable belt (9) are respectively fixed to upper ends of the two bottom tubes (14) on a right side.

8. The foldable hammock according to claim 3, wherein the main frame assembly (1) further comprises two portable belts (9), two ends of one said portable belt (9) are respectively fixed to upper ends of the two bottom tubes (14) on a left side, and two ends of the other portable belt (9) are respectively fixed to upper ends of the two bottom tubes (14) on a right side.

* * * * *